US005121766A

United States Patent [19]

Tornay

[11] Patent Number: 5,121,766

[45] Date of Patent: Jun. 16, 1992

[54] SYSTEM FOR CONTROL OF OIL LEAKAGE FROM DAMAGED TANKER

[75] Inventor: Edmund G. Tornay, New York, N.Y.

[73] Assignee: Energy Transportation Group, Inc., New York, N.Y.

[21] Appl. No.: 728,200

[22] Filed: Jul. 10, 1991

[51] Int. Cl.[5] ..... F16K 31/12

[52] U.S. Cl. ..... 137/68.1; 114/74 R

[58] Field of Search ..... 137/68.1; 251/147; 114/74 R

[56] References Cited

U.S. PATENT DOCUMENTS

| | | | |
|---|---|---|---|
| 1,193,528 | 8/1916 | Eley . | |
| 3,334,608 | 8/1967 | Nemoto et al. | 114/74 |
| 3,745,960 | 7/1973 | Devine | 114/74 R |
| 3,812,807 | 5/1974 | Ando | 114/74 R |
| 3,832,966 | 9/1974 | Garcia | 114/74 R |
| 3,906,880 | 9/1975 | Herbert | 114/74 R |
| 3,957,009 | 5/1976 | DiPerna | 114/74 R |
| 4,389,959 | 6/1983 | Conway | 114/74 R |
| 4,519,411 | 5/1985 | Takahashi | 137/68.1 |
| 4,549,267 | 10/1985 | Drabouski, Jr. | 364/463 |

*Primary Examiner*—John C. Fox

*Attorney, Agent, or Firm*—Brumbaugh, Graves, Donohue & Raymond

[57] ABSTRACT

Outflow of oil from a damaged tanker having some tanks dedicated for carriage of oil and others for sea water ballast is minimized by transferring oil out of the upper part of any damaged tank to one or more empty ballast tanks. This is accomplished by installing a passageway in bulkheads common to a cargo tank and a ballast tank which is normally closed by at least a one-shot valve including a blank flange bolted to a section of pipe and a hydraulic hose compressed by the flange which, when pressurized, breaks the bolts to release the flange and open the passageway to allow oil to flow from the damaged cargo tank to a ballast tank.

3 Claims, 3 Drawing Sheets

SYSTEM FOR CONTROL OF OIL LEAKAGE FROM DAMAGED TANKER

BACKGROUND OF THE INVENTION

This invention relates generally to tankers for carriage of liquids such as oil and, more particularly, to a system for control of oil leakage from a damaged tanker. In a more specific sense, the invention relates to improvements to the oil leakage control system described in applicant's U.S. Pat. No. 4,964,437 dated Oct. 23, 1990.

Briefly, the system described in the patent, the disclosure of which is hereby incorporated herein by reference, minimizes the outflow of oil from a damaged cargo tank of an oil tanker of the "segregated ballast" type by transferring oil out of the upper part of the damaged cargo tank and at the same time, keeping to a minimum the reduction of draft at the damaged area. This is accomplished by valves and piping installed through selected bulkheads for connecting each cargo tank to one or more ballast tanks, one or more of the valves being opened upon occurrence of damage sufficient to cause cargo tank leakage, allowing oil to flow, by gravity, from the upper part of the damaged cargo tank or tanks to one or more ballast tanks which, if the tanker were loaded, would be empty. Each connection between a cargo tank and a ballast tank includes two valves, either butterfly or sluice valves, connected in tandem, as required by regulations to prevent oil contamination of ballast as any occur from valve leakage in normal operation. The valves typically have a diameter in the range from three to five feet, the choice being a tradeoff between the cost of the valves and the rate at which it is desired to transfer oil from the damaged cargo tank to the ballast tank(s), and each is equipped with an actuator for opening and closing the valve. Considering that a typical tanker may require at least ten such pairs of valves to effectively control oil leakage by this method, the installation obviously is expensive.

A less expensive and more effective valve structure for use in the system is described in applicant's co-pending application Ser. No. 07/510,932 filed Apr. 19, 1990, entitled "Valve Structure". The disclosed valve structure includes a butterfly valve bolted to one end of a short section of pipe which is welded to the bulkhead separating a cargo tank from a ballast tank in combination with a rupturable disk fitted within the pipe section between the rotatable disk of the butterfly valve and the bulkhead and capable of withstanding the maximum pressure of either a full ballast tank or a full cargo tank. A cutter is secured to the rotatable disk of the butterfly valve which, when the butterfly valve is opened in response to detected leakage from an associated cargo tank, slices the rupturable disk sufficiently to assure its collapse and failure by oil flowing through the open butterfly valve. Although less expensive than two butterfly or sluice valves in tandem, this structure is subject to corrosion and not readily amenable to testing.

It is a primary object of the present invention to provide an improved system for minimizing the outflow of oil from a damaged tanker of the "segregated ballast" type.

Another object of the invention is to provide a valve arrangement for initiating oil flow from a damaged cargo tank to a ballast tank which is more effective for the purpose, and less expensive, than paired butterfly valves or the butterfly valve/rupturable disk combination.

Another object is to provide a valve structure which minimizes the possibility of leakage between a cargo tank and a ballast tank without relying on valve seals.

SUMMARY OF THE INVENTION

Briefly, as in the system described in the aforesaid patent, the outflow of oil from a damaged tanker is minimized by transferring oil out of the upper part of any damaged cargo tank and, at the same time, keeping to a minimum the reduction of draft at the damaged area. This is accomplished by installing in each bulkhead common to a cargo tank and ballast tank, at a predetermined height above the bottom of the tanker, a section of pipe defining a passageway for oil which is normally closed at one end by a butterfly valve and is normally closed at the other end with a positive sealing one-shot valve including a blank flange bolted to the pipe and a high pressure hydraulic hose compressed by the flanges and operative when pressurized to break the flange bolts and thereby release the flange. Upon occurrence of damage sufficient to cause cargo tank leakage, an instrumentation and control system opens one or more of the butterfly valves and applies hydraulic pressure to associated hydraulic hoses, thereby to open one or more passageways to allow oil to flow, by gravity, from the upper part of the damaged cargo tank or tanks to one or more ballast tanks which, if the tanker were loaded with oil, would be empty. Although some oil will go overboard, the amount will be reduced by the predictable and substantial flow to the ballast tank(s), the relative amounts lost overboard and transferred to the ballast tank or tanks depending on the relative sizes of the interconnected piping and the opening in the ruptured cargo tanks.

Other objects, features and advantages of the invention will become apparent, and its construction and operation better understood, from the following detailed description read in conjunction with the accompanying drawings.

DESCRIPTION OF THE PREFERRED EMBODIMENT

Figure 1:
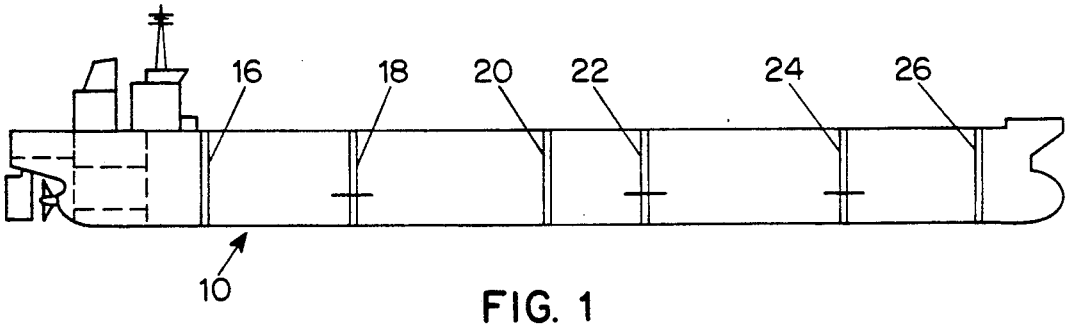
FIG. 1 is a diagrammatic elevation cross-sectional view of an oil tanker of the segregated ballast type.
Figure 2:
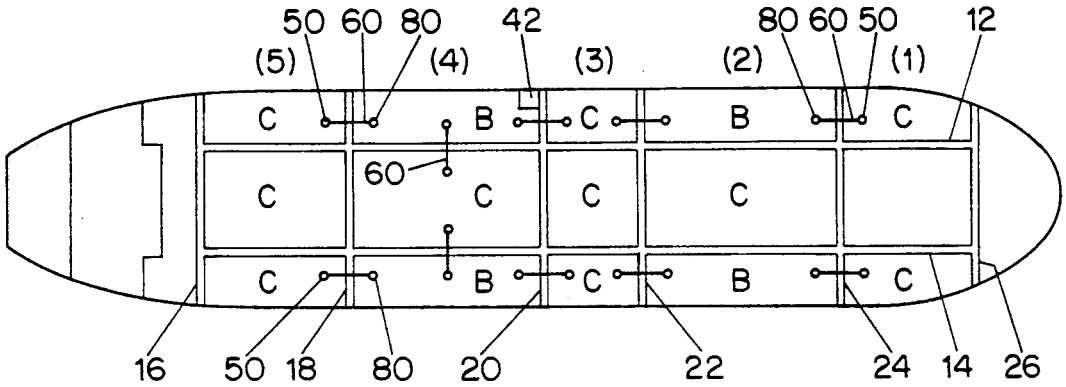
FIG. 2 is a diagrammatic plan view of the tanker.

FIGS. 1 and 2 diagrammatically illustrate an oil tanker 10 of the "segregated ballast" type which is subdivided by longitudinal bulkheads 12, 4 and transverse bulkheads 16, 18, 20, 22, 24, 26 to form a plurality of tanks, numbered (1) to (5) from bow to stern in FIG. 2, some of which are dedicated for carriage of cargo oil and others of which are dedicated for carriage of sea water ballast, designated "C" and "B", respectively.

The longitudinal bulkheads 12 and 14 together with portions of the transverse bulkheads define five center cargo tanks, and with the hull and other portions of the transverse bulkheads define two sets of wing tanks alternately dedicated for cargo and ballast. While it is the intention of international regulations that the ballast tanks be used only for sea water ballast, for the practice of the present invention they are used as emergency receptacles for cargo oil in the event of damage to one or more cargo tanks, such use being justified on the ground that containment is preferable to outflow of oil, and the ballast tanks can, in any case, be cleaned.

When the tanker is loaded, the cargo tanks "C" are filled almost to the top and the ballast tanks "B" are all empty or nearly empty . In order to minimize oil outflow in the event one or more cargo tanks is ruptured by grounding or collision, valves and associated piping are fitted in the bulkheads to provide passageways, when the valve are open, from each cargo tank to one or more ballast tanks. As shown in FIG. 2, assemblies of paired valves 50 and 80 secured to opposite ends of a connecting pipe 60 are installed in selected bulkheads shared by a cargo tank and a ballast tank, the selection of ballast tanks to be connected to each cargo tank depending on the number and arrangement of the tanks on the ship. Thus, each connection between a cargo tank and a ballast tank has two valves in series as required by regulations, to prevent contamination of ballast due to minor valve leakage in normal operation. Each connection is installed at a vertical height above the bottom of the tanker corresponding approximately to the tanker's beam divided by fifteen.

Figure 3:
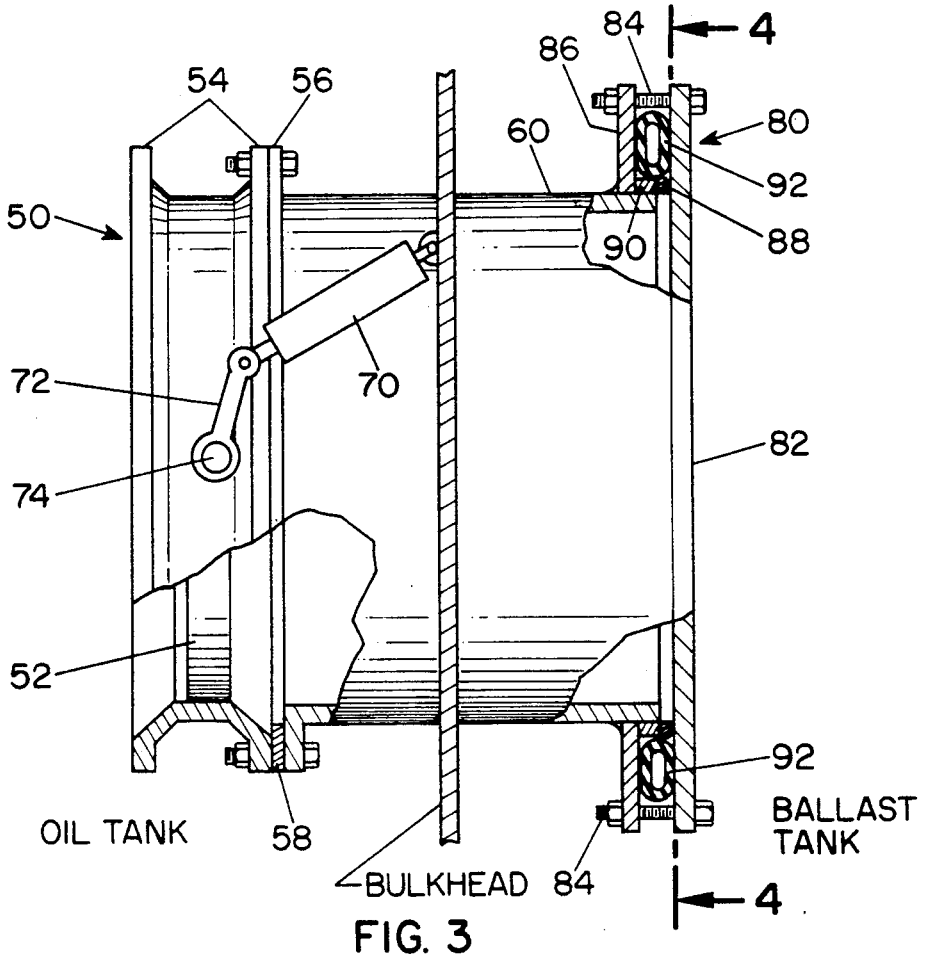
FIG. 3 is a top view, partially cut away and partially in section, of a valve structure according to the invention.

In accordance with the present invention, as shown in FIG. 3, valve 50 preferably is of the butterfly type and is bolted to a short section 60 of flanged pipe which is welded or otherwise secured in sealing relationship in an opening in a bulkhead which is common to an oil tank and a ballast tank. The construction of butterfly valve 50 is conventional, including a circular valve disk 52 mounted in sealing relationship within a short flanged cylinder 54 for rotation about a vertical axis to effect opening and closing. One flange of the valve housing is bolted to a circumferential flange 56 formed on the pipe section and sealed therewith by an annular sealing ring 58 disposed between the bolted-together flanges. The valve disk 52 is activated by a conventional hydraulic ram 70 secured at one end to the bulkhead with its ram pivotally connected to one end of a crank arm 72, the other end of which is secured to the upper end of a vertically oriented spindle 74 secured to valve disk 52 and supported in the valve housing for rotation about a vertical axis.

The other end of the pipe section 60, the end which extends into a ballast tank, is normally closed with a positive sealing one-shot valve 80 which comprises a circular blank flange 82 secured to the pipe section by a multiplicity of bolts 84 which extend through openings in flange 82 and through aligned openings in an annular-shaped flange 86 having an inner diameter which corresponds to the outer diameter of pipe 60 and is welded to the pipe section at or near the end. The blank flange is sealed to the end of the pipe by a suitable gasket 88, for example a large "O"-ring, pressed between flange 82 and the face of a raised flange 90 of annular shape welded to flange 86 at its juncture with the pipe section. Typically, the pipe 60 is 48 inches in diameter, the flanges 82 and 86 are one-inch steel plate and have an outside diameter of 70 inches, and the blank flange is secured with thirty-six $\frac{5}{8}$-inch steel or stainless steel bolts, uniformly distributed along a concentric circle having a diameter of 65 inches.

Figure 5:
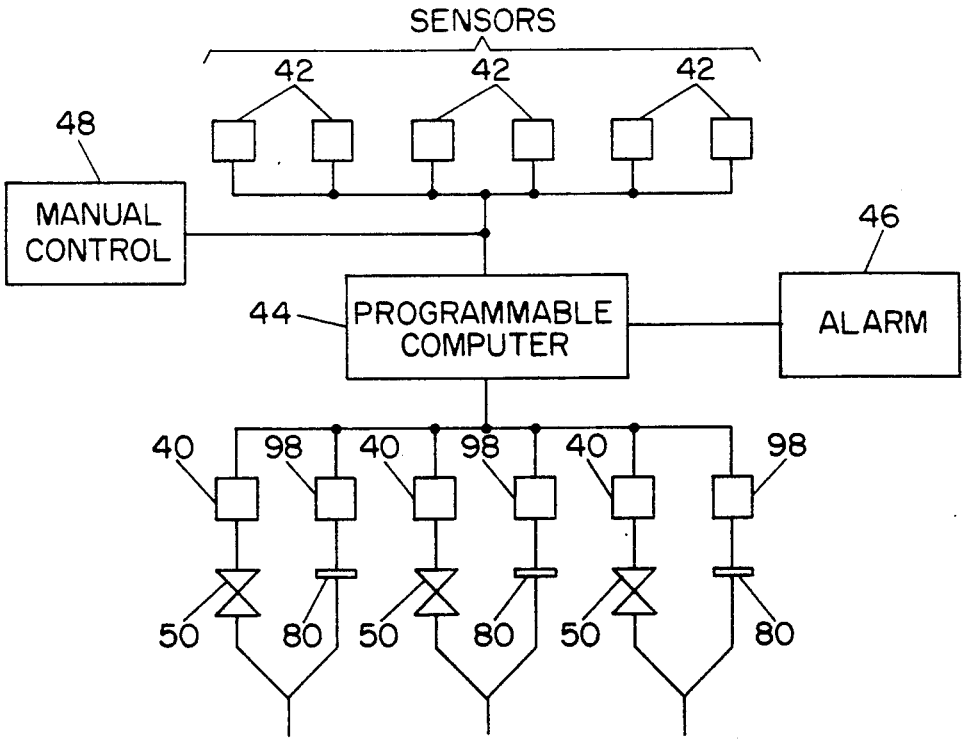
FIG. 5 is a schematic block diagram showing instrumentation and control apparatus for the system according to the invention.
Figure 4:
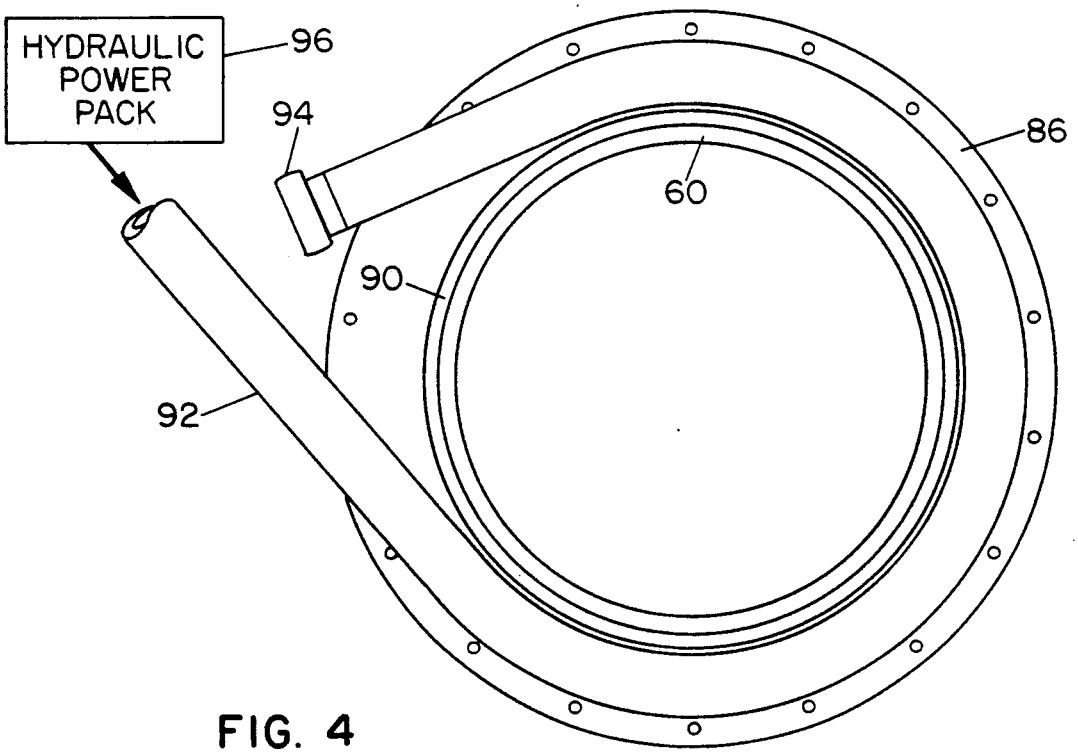
FIG. 4 is an elevation cross-sectional view taken along line 4—4 of FIG. 3.

The valve 80 is opened by breaking the flange bolts 84 so as to release the flange 82, this being accomplished by pressurizing a reinforced rubber hose 92 disposed and flattened between flanges 82 and 86, as seen in FIG. 3, as the bolts 84 are tightened to compress the gasket 88. As shown in FIG. 4, the hose is placed within the circular array of bolts and projects outwardly beyond the periphery of the flanges at about the same point so as to form essentially a closed circle. The hose 92 is closed at one end by a suitable pressure cap 94, and its other end is connected via suitable hoses and fittings (not shown) to a source of hydraulic power 96 capable of pressurizing the hose to a predetermined pressure in the event it should become necessary to open the passageway. The source 96 may be a hydraulic power pack of known construction, consisting essentially of a hydraulic pump and an electric motor, which is commercially available from several manufacturers, including Vickers Hydraulics, York Industries and Dayton. Typically, the hose 92 has an inside diameter of two inches and is designed to withstand a pressure of at least 3000 psi. As shown in the diagram of FIG. 5, each hydraulic power pack 96 is equipped with an actuator 98 which is operative responsively to an applied control signal to quickly generate and apply to its associated high pressure hose hydraulic pressure sufficient to fracture the bolts 86, whereupon the blind flange is released and drops into the associated ballast tank. In a one-shot valve constructed as described, all of the bolts are fractured when a pressure in the range from about 1500 psi to about 3000 psi is sustained for a minute or so. The abrupt drop in pressure within the hose that occurs when the bolts are broken may be used to turn off the hydraulic power pack. Since the companion butterfly valve 50 will have been opened in response to the same control signal, removal of the blank flange will be assisted by the oil flowing from the damaged cargo tank.

A level sensor 42 installed in each cargo tank, one of which is shown in FIG. 2 and six of which are shown in the schematic diagram of FIG. 5, detects a drop in oil level as would be caused by outflow of oil therefrom and in response generates and applies an output signal to a programmable computer 44. Upon receipt of a signal from one or more sensor, the computer sounds an alarm 46 and applies a control signal to each of the valve actuators 40 and hydraulic power pack actuators 98 appropriate to open the passageways that will minimize oil outflow. The computer is preprogrammed to open the passageways appropriate for redistributing the cargo to minimize overboard leakage and at the same time control trim, heel and stability of the vessel within safe limits. The instrumentation preferably includes an override control 48 and display panel (not shown) mounted on the bridge of the tanker for enabling manual operation of the valve 50/one shot valve 80 combination should conditions require.

In operation, in the event a loaded tanker sustains damage that allows oil to flow out of the hull, the sensor 42 in the affected cargo tank or tanks transmits an output signal to the computer 44 which, in turn, causes appropriate butterfly valves and one-shot valves to be opened to allow oil to flow from the upper part of the damaged cargo tank or tanks to a selected ballast tank or tanks, which would be empty. Although some oil will continue to go overboard, the amount will be reduced by the substantial flow of oil to the ballast tank (s), the volume of which and, accordingly, the time required to drop the oil level in the damaged tank to just above the water level, are predictable. By containing the oil which would otherwise be discharged overboard the weight of the vessel is not significantly reduced; because the outflow is reduced the tanker does not rise much out of the water and the draft at the area of damage is substantially maintained which, in itself, contributes to a decrease in oil outflow. The relative amounts lost overboard and transferred to ballast tank(s) depend on the relative sizes of the valved passageway and the rupture in the cargo tanks or tanks. The velocity of oil flow through the passageway to the ballast tanks will be much higher than the flow overboard because the pressure head is the height of the cargo above the passageway, whereas the driving head of the overboard leakage is the height of the cargo above the water line. No pumps are required, the transfer of oil from cargo tank to ballast tank being accomplished entirely by gravity, with assistance from the phenomenon that oil flow out of the hull ceases when the oil level in a ruptured tank drops to just above the water level.

Figure 6:
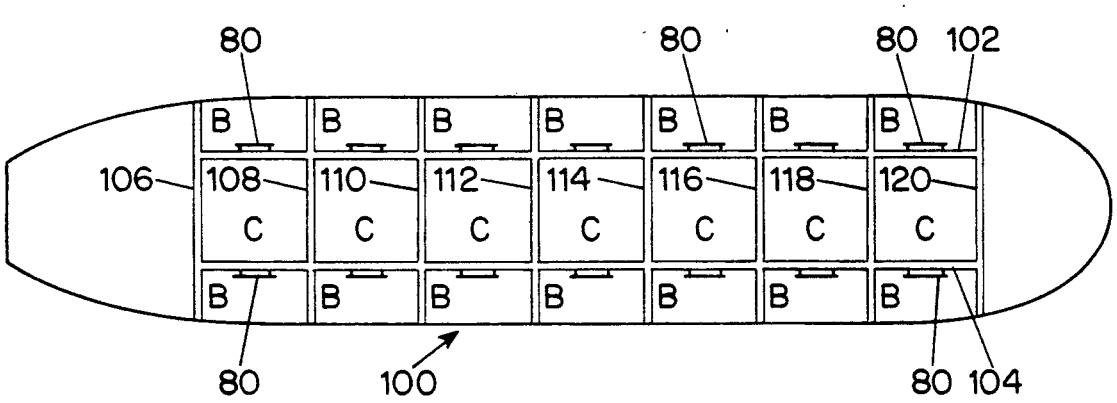
FIG. 6 is a diagrammatic plan view of a tanker of the double-sided type illustrating another application of the positive sealing one-shot valve of the invention.

The described system for controlling overboard oil leakage is also applicable to the tanker design depicted in FIG. 6 intended for new construction. The hull 100 has a single bottom and typically is sub-divided by longitudinal bulkheads 102 and 104 and transverse bulkheads 106, 108, 110, 112, 114, 116, 118, and 120 to form seven cargo tanks "C" distributed along the center each having associated therewith a pair of collision-protection side tanks dedicated for carriage of sea water ballast. In terms of pollution protection, this design is comparable to the double hull and Mitsubishi mid-deck design, yet costs little more than a single hull tanker.

The cost of the equipment for controlling overboard oil leakage from a tanker of this design is much lower than the above-described system in that the passageway from cargo tank to ballast tank is closed with only a one-shot valve 80, thereby to eliminate the cost of installing a butterfly valve at one end of each pipe section. One or more one-shot valves are installed in each bulkhead shared by a cargo tank and a ballast tank and, because their size is not restricted by commercially available sizes of butterfly valves, may be made larger than the suggested 48-inch passageway of the "combination" valve, whereby to shorten the time required to drop the oil level in a damaged tank to just above the water level. The system can be easily tested any time the tanks are empty, the test requiring only repositioning the flange 82 and replacing the bolts 86.

While preferred embodiments of the invention have been described, it will be evident that various changes and modifications may be effected without departing from the spirit and scope of the inventive concepts. It is to be understood that the invention is not limited to the illustrated embodiments, the intention being to cover by the appended claims all such modifications as fall within their scope.

I claim:

1. A fluid control arrangement adapted to be fitted in an opening in a bulkhead common to a liquid cargo tank and a ballast tank, comprising:

a section of pipe extending through and sealingly secured in an opening in a bulkhead and defining a passageway for fluid to flow from a cargo tank to a ballast tank; and one-shot valve means in sealing relationship with a first end of said pipe section, said valve means comprising an annular flange secured to said first end of said pipe section, a blank circular flange, a high pressure hydraulic hose arranged substantially in a circle between said annular flange and said circular blank flange, and a plurality of bolts extending through respective openings in said flange for compressing said hydraulic hose and forcing said blank flange into sealing relationship with said first end of said pipe section, said hydraulic hose when pressurized being operative to break said bolts and thereby release said blank circular flange for opening said passageway.

2. A fluid control arrangement according to claim 1, wherein said hydraulic hose is closed at one end, and wherein means for pressurizing said hydraulic hose to a pressure sufficient to break said bolts is connected to the other end of said hose.

3. A fluid control arrangement according to claim 2, wherein said means for pressurizing said hydraulic hose comprise a hydraulic power pack for generating hydraulic pressure.

* * * * *